US011072350B2

(12) United States Patent
Mock

(10) Patent No.: US 11,072,350 B2
(45) Date of Patent: Jul. 27, 2021

(54) CEILING MODULE FOR A VEHICLE

(71) Applicant: SIEMENS MOBILITY GMBH, Munich (DE)

(72) Inventor: Stefan Mock, Schwalmtal (DE)

(73) Assignee: Siemens Mobility GmbH, Munich (DE)

( * ) Notice: Subject to any disclaimer, the term of this patent is extended or adjusted under 35 U.S.C. 154(b) by 321 days.

(21) Appl. No.: 16/091,194

(22) PCT Filed: Mar. 10, 2017

(86) PCT No.: PCT/EP2017/055647
§ 371 (c)(1),
(2) Date: Oct. 4, 2018

(87) PCT Pub. No.: WO2017/174291
PCT Pub. Date: Oct. 12, 2017

(65) Prior Publication Data

US 2019/0111948 A1 Apr. 18, 2019

(30) Foreign Application Priority Data

Apr. 4, 2016 (DE) ..... 10 2016 205 490.2

(51) Int. Cl.
*B61D 17/12* (2006.01)
*B61D 17/16* (2006.01)

(52) U.S. Cl.
CPC ..... *B61D 17/16* (2013.01); *B61D 17/12* (2013.01)

(58) Field of Classification Search
CPC ..... B61D 17/12; B61D 17/16; B61D 29/00; Y10T 16/5362; E05D 1/04; E05D 5/02; E05D 7/1055; E05D 7/12; F21V 17/107
USPC ..... 16/268
See application file for complete search history.

(56) References Cited

U.S. PATENT DOCUMENTS

| | | | | |
|---|---|---|---|---|
| 892,993 | A * | 7/1908 | Higgins | E05D 7/1066 16/267 |
| 2,440,186 | A * | 4/1948 | Runge | F21V 17/16 362/341 |
| 2,912,568 | A * | 11/1959 | Winkler | F21V 17/107 362/375 |
| 3,506,822 | A * | 4/1970 | Boake | F24F 13/072 362/331 |
| 9,586,601 | B2 * | 3/2017 | Meergans | B61D 27/00 |
| 2014/0063803 | A1 * | 3/2014 | Yaphe | F21V 15/013 362/247 |
| 2014/0087645 | A1 * | 3/2014 | Hoefler | B61D 27/0072 454/83 |

(Continued)

FOREIGN PATENT DOCUMENTS

| | | | |
|---|---|---|---|
| AU | 2012234332 | B2 | 10/2012 |
| CN | 201151392 | Y | 11/2008 |
| CN | 102381327 | A | 3/2012 |

(Continued)

*Primary Examiner* — Mark T Le
(74) *Attorney, Agent, or Firm* — Laurence Greenberg; Werner Stemer; Ralph Locher

(57) ABSTRACT

A ceiling module for a vehicle has a pivotally mounted ceiling flap for covering a ceiling opening, and a carrier device for holding one or more electrical components. In order to save space in the vehicle, the carrier device includes a lateral wall with a hinge opening on which the ceiling flap is pivotally mounted.

14 Claims, 3 Drawing Sheets

(56) References Cited

U.S. PATENT DOCUMENTS

2015/0124440 A1* 5/2015 Janjua ..... F21V 19/004
362/223

FOREIGN PATENT DOCUMENTS

| | | | | |
|---|---|---|---|---|
| CN | 103384624 | A | | 11/2013 |
| JP | 2006079918 | A | | 3/2006 |
| KR | 10-2013-0013523 | | * | 2/2013 |
| RU | 51578 | U1 | | 2/2006 |

* cited by examiner

CEILING MODULE FOR A VEHICLE

BACKGROUND OF THE INVENTION

Field of the Invention

The invention relates to fa ceiling module for a vehicle which comprises a pivotably supported ceiling flap for covering a ceiling opening and a carrier device for retaining one or more electrical components.

In vehicles, in particular in rail vehicles, technical devices are often accommodated in the ceiling region between an inner ceiling and a railcar body roof of the respective vehicle.

In order to enable technical operators to have simple and rapid access to the technical devices, for example, for maintenance purposes, there are generally provided in the ceiling region of such a vehicle pivotable ceiling flaps, by means of which a ceiling opening of the vehicle can be released and closed again in each case.

Furthermore, in vehicles, in particular in vehicles which are used for passenger transport, there are generally arranged in the ceiling region carrier devices, to which electrical components, such as, for example, illumination means for illuminating a passenger space and/or elements of a passenger information system are fitted.

SUMMARY OF THE INVENTION

An object of the invention is to provide a ceiling module for a vehicle, by means of which space can be saved in the vehicle.

This object is achieved according to the invention by a ceiling module as claimed.

The ceiling module according to the invention comprises a pivotably supported ceiling flap for covering a ceiling opening and a carrier device for retaining one or more electrical components. Furthermore, there is provision with the ceiling module according to the invention for the carrier device to have a side wall having a hinge opening on which hinge opening the ceiling flap is pivotably supported.

Advantageous developments of the ceiling module according to the invention are set out in the dependent claims and the following description.

The invention is based on the recognition that previously used hinges for pivotably supporting ceiling flaps take up a degree of structural space in the ceiling region of a vehicle. Consequently, the space available for other technical devices in the ceiling region is reduced as a result of the hinges.

As a result of the fact that the carrier device of the ceiling module has a hinge opening, the carrier device may act as an element of a hinge for the ceiling flap. In other words, the hinge opening of the carrier device may together with an element of the ceiling flap form a hinge (also referred to as a rotary joint).

The carrier device may thus in addition to the function thereof for retaining one or more electrical components, such as, for example, an illumination means and/or a passenger information system device, at the same time act as an element of a hinge for the ceiling flap. Consequently, the carrier device may have a multiple functionality.

The hinge opening enables the ceiling flap to be supported directly on the carrier device. In addition, the hinge opening enables the number of components which are required to form a hinge for pivotably supporting the rotary flap to be reduced.

As a result of the integration of a hinge function in the carrier device, in the vehicle, in particular in the ceiling region thereof, considerable structural space may be saved. The structural space saved can in turn be used for other technical devices.

Advantageously, the ceiling module is provided for installation in the roof region of a vehicle and/or configured for this purpose.

The ceiling flap is advantageously provided for opening and closing a ceiling opening of the vehicle. In the assembled state of the ceiling module—that is to say, in the state in which the ceiling module is mounted in the vehicle—the ceiling flap enables, preferably from a passenger space of the vehicle, access to an intermediate ceiling space between a railcar body roof of the vehicle and the passenger space ceiling thereof.

Preferably, the carrier device is an illumination means carrier. The carrier device is thus preferably configured for retaining an illumination means, such as, for example, an LED, a fluorescent tube and/or another type of illumination means, or a plurality of such illumination means. Advantageously, at least one illumination means is secured to the illumination means carrier. Such an illumination means which is secured to the illumination means carrier is advantageously used for illuminating the passenger space of the vehicle.

Furthermore, at least one additional electrical or electronic component may be secured to the illumination means carrier, such as, for example, an element of a passenger information system.

Furthermore, the ceiling module may be constructed in accordance with a fire protection standard. The ceiling module may thus be configured in such a manner that it complies with one or more fire protection standards, such as, for example, the fire protection standard EN 45545-2 and/or the British fire protection standard GM/RT 2130.

Advantageously, the hinge opening is a clear opening. The hinge opening may in particular be a milled opening. That is to say, the hinge opening may have been produced using a milling device by milling material from the side wall of the carrier device.

The hinge opening preferably has an edge which at least partially has a rounded cross-sectional shape. The edge may thus, for example, have a circular or substantially circular cross-sectional shape.

It is further advantageous for a portion of the edge of the hinge opening, in particular the portion with the rounded cross-sectional shape, to form a rotation axis about which the ceiling flap can be rotated or pivoted. Such a portion may be, for example, a rim of the edge.

It is particularly preferable for the side wall to have a thickened portion. The thickened portion may in particular form the edge of the hinge opening. Furthermore, the thickened portion may act as a support face for the ceiling flap.

Furthermore, it is advantageous for the ceiling flap to comprise a retention element. Advantageously, a portion of the retention element rests on the edge of the hinge opening. That is to say, the retention element may rest partially on the edge of the hinge opening. Advantageously, the hinge opening forms a hinge together with the retention element of the ceiling flap.

The retention element preferably has a hook portion with a shape which is bent in a hook-like manner. Furthermore, it is preferable for the retention element to be hooked with the hook portion thereof on the edge of the hinge opening.

It is further advantageous for a width of the retention element, in particular a width of the hook portion, to correspond to at least 60% of the width of the hinge opening. In this manner, a secure retention of the retention element on the edge of the hinge opening can be achieved.

Advantageously, the retention element comprises a securing portion. Furthermore, it is advantageous for the retention element to comprise an intermediate portion, in particular an intermediate portion which is arranged perpendicularly to the securing portion. Preferably, the intermediate portion merges at one end into the securing portion and at the other end into the above-mentioned hook portion.

The securing portion may in particular be constructed integrally with the hook portion and/or the intermediate portion. Furthermore, the retention element may be constructed as an extruded profile, in particular as an aluminum or steel extruded profile. This is because extruded profiles can be produced in a low-cost manner with a low level of complexity.

Furthermore, the ceiling flap advantageously has a wall unit which may comprise one or more walls. Preferably, the wall unit is secured to the securing portion of the retention element.

It is particularly preferable for the wall unit to comprise an inner wall and an outer wall. The term outer wall may be understood to refer to the wall of the wall unit which in the assembled state of the ceiling module with the ceiling flap closed is visible in the passenger space. The term inner wall in contrast may be understood to refer to the wall of the wall unit which in the assembled state of the ceiling module with the ceiling flap closed is not visible in the passenger space.

The outer wall and the inner wall may, for example, be connected to each other by means of a plurality of struts. Advantageously, the inner wall is in contact with the retention element, in particular with the securing portion thereof. Furthermore, it is advantageous for the outer wall to have a material which forms a ceiling lining.

The carrier device advantageously has a base wall. There is/are preferably secured to the base wall at least one illumination means and/or at least one passenger information system device, such as, for example, a loudspeaker for announcements from the vehicle operators. Furthermore, electronic components and/or cables for such an illumination means and/or such a passenger information system device may be secured to the base wall.

Preferably, the side wall which has the hinge opening is arranged perpendicularly or substantially perpendicularly to the base wall. The term "substantially perpendicularly" may be understood in such a manner that a first element which is arranged substantially perpendicularly to a second element is arranged at an angle between 80° and 90° with respect to the second element.

In the assembled state of the ceiling module, the base wall of the carrier device is advantageously orientated in a horizontal manner. In contrast, the side wall of the carrier device is in the assembled state of the ceiling module advantageously orientated in a perpendicular manner.

Furthermore, the hinge opening is preferably in the form of a rounded rectangle. In other words, the hinge opening may be formed in the manner of a rectangle with rounded corners. Such a shape can be produced with a low level of complexity, for example, using a milling device.

Since extruded profiles can be produced in a cost-effective manner with a low level of complexity, it is advantageous for the carrier device to be constructed as an extruded profile, in particular as an aluminum or steel extruded profile.

In a preferred development of the invention, the ceiling module has a covering unit for covering the carrier device. The covering unit may partially or completely cover or conceal the carrier device. Advantageously, the covering unit covers the carrier device in the assembled state of the ceiling module from below.

Advantageously, the covering unit comprises a covering plate. Preferably, the covering plate is an opaque covering plate, that is to say, a covering plate which scatters in a diffuse manner. When an illumination means which is secured to the carrier device is used, a passenger may thereby be given the impression that the passenger space is illuminated with "soft" or "dimmed" light. The covering plate may, for example, have glass or polycarbonate as an opaque material.

Furthermore, a part-region of the covering plate, for example, a central region of the covering plate, may be colored. In particular, the part-region of the covering plate may be colored so as to be impermeable to light. In this manner, it may be possible in the assembled state of the covering unit for an element which is arranged behind the colored region not to be visible from the passenger space.

It is further advantageous for the covering unit to comprise at least one securing element. With the securing element thereof, the covering unit is advantageously secured to the carrier device.

The covering plate of the covering unit may in particular be constructed integrally with the securing element. Alternatively, the securing element may, for example, be adhesively bonded to the covering plate or connected to the covering plate in another manner.

Furthermore, the securing element may, for example, be connected to the carrier device by means of a releasable engagement connection.

This enables the covering unit to be assembled and disassembled on the carrier device with a low level of complexity.

Alternatively or additionally, the securing element may be connected to the carrier device using a securing means, such as, for example, a screw and/or a rivet. Preferably, the covering device comprises a plurality of securing elements for securing the covering unit to the carrier device.

According to an advantageous embodiment of the invention, the ceiling module has an additional ceiling flap. The additional ceiling flap is advantageously provided for opening and closing an additional ceiling opening. Individual features or all of the (optional) features mentioned above in connection with the first ceiling flap mentioned may also relate to the additional ceiling flap. The additional ceiling flap may afford technical operators rapid and non-complex access to additional technical devices in the ceiling region of the vehicle.

It is further advantageous for the carrier device to have an additional hinge opening. The additional ceiling flap is advantageously supported on this additional hinge opening.

The invention further relates to a vehicle which has a ceiling module according to the above description. Preferably, the vehicle is a vehicle which is used in public transport. It is particularly preferred if the vehicle is a rail vehicle. Alternatively, the vehicle may, for example, be a coach.

The vehicle advantageously has a railcar body roof. It is advantageous for the carrier device of the ceiling module to be secured to the railcar body roof, in particular using one or more securing profiles.

It is further advantageous for the vehicle to have a passenger space ceiling. A passenger space ceiling (also referred to as an inner ceiling) may in this instance be understood to be a ceiling which delimits a passenger space of a vehicle in an upward direction. Advantageously, the passenger space ceiling is a ceiling of the vehicle which is visible inside the passenger space.

Advantageously, the ceiling flap of the ceiling module, in particular the wall unit thereof, forms a portion of the passenger space ceiling. The covering plate of the ceiling module in turn preferably forms another portion of the passenger space ceiling.

The above description of advantageous embodiments of the invention contains numerous features which are set out in the individual dependent claims, sometimes combined together. However, these features may advantageously also be considered individually and be combined to form advantageous additional combinations. In particular, these features can each be combined individually and in any suitable combination with the device according to the invention.

Even when, in the description or in the patent claims, some terms are used in the singular or together with a numeral, the scope of the invention for these terms is not intended to be limited to the singular or the respective numeral.

The above-described properties, features and advantages of the invention and the manner in which they are achieved will be understood more clearly and unambiguously in connection with the following description of the embodiments of the invention which will be explained in greater detail in connection with the drawings. The embodiments serve to explain the invention and do not limit the invention to the combinations of features set out therein, including not with respect to functional features. Furthermore, to this end, suitable features of each embodiment may also be considered explicitly in isolation, removed from an embodiment, introduced into another embodiment in order to supplement it and combined with any of the claims.

In the drawings, embodiments of the invention which are explained in greater detail below are illustrated.

DESCRIPTION OF THE INVENTION

Figure 1:
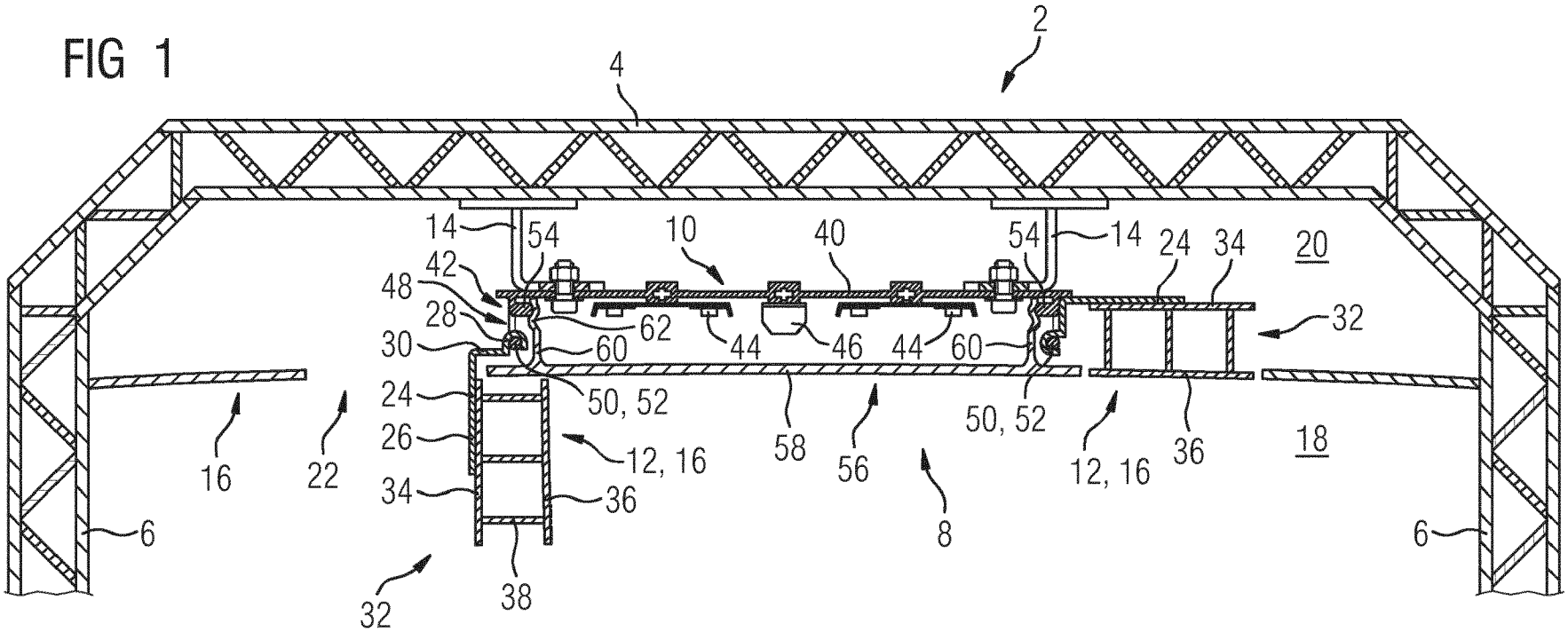
FIG. 1 is a sectioned illustration of a portion of a rail vehicle having a ceiling module, which has a carrier device and two ceiling flaps.

FIG. 1 is a sectioned illustration of a portion of a rail vehicle 2. The illustrated cross-section is a section perpendicular to the longitudinal vehicle direction.

An upper region of the rail vehicle 2 is illustrated. In FIG. 1, a railcar body roof 4 of the rail vehicle 2 and a portion of two railcar body side walls 6 which are adjacent to the railcar body roof 4 can be seen.

The rail vehicle 2 has a ceiling module 8 which comprises a carrier device 10 which is constructed as an extruded profile and two ceiling flaps 12. The carrier device 10 is secured to the railcar body roof 4 of the rail vehicle 2 using two securing profiles 14 which are screwed to the carrier device 10. The securing profiles 14 may be welded, screwed to the railcar body roof 4 or connected to the railcar body roof 4 in another manner.

Both ceiling flaps 12 are ceiling flaps which open downward. The left ceiling flap 12 in the drawing is illustrated in the open state, whereas the right ceiling flap 12 in the drawing is illustrated in the closed state.

Furthermore, the rail vehicle 2 has a passenger space ceiling 16 which is formed from a plurality of elements and which delimits a passenger space 18 of the rail vehicle 2 in an upward direction. Furthermore, the passenger space ceiling 16 defines together with the railcar body roof 4 an intermediate ceiling space 20 which is delimited by the railcar body roof 4 in an upward direction and by the passenger space ceiling 16 in a downward direction.

Furthermore, the passenger space ceiling 16 has two ceiling openings 22. Each of the two ceiling flaps 12 is configured to close one of the ceiling openings 22 and to release it again.

Furthermore, the ceiling flaps 12 each comprise a retention element 24 which is constructed as an extruded profile and which has a securing portion 26, a hook portion 28 which is bent in the form of a hook and an intermediate portion 30 which is arranged perpendicularly to the securing portion and which merges at one end into the securing portion 26 and at the other end into the hook portion 28.

Furthermore, the ceiling flaps 12 each comprise a wall unit 32 with an inner wall 34 and an outer wall 36 which is arranged parallel with the inner wall 34. The wall unit 32 of the respective ceiling flap 12 is secured to the retention element 24 of the respective ceiling flap 12, in particular to the securing portion 28 thereof. In addition, the inner wall 34 and the outer wall 36 of the respective wall unit 32 are connected to each other by means of a plurality of struts 38.

Furthermore, the carrier device 10 has a base wall 40 which in the assembled state of the ceiling module 8—that is to say, in the state illustrated in FIG. 1—is orientated horizontally. Furthermore, the carrier device 10 has two side walls 42 which are orientated perpendicularly to the base wall 40.

The carrier device 10 is an illumination means carrier, wherein a plurality of illumination means 44 are secured to the base wall 40. In the present embodiment, on the base wall 40 four rows of LEDs which are orientated perpendicularly to the drawing plane are fitted as illumination means 44.

Furthermore, a passenger information system device 46, in the present embodiment a loudspeaker for announcements of the vehicle operators, is secured to the base wall 40. Furthermore, power supply lines and where applicable an electronic control unit for the illumination means 44 and/or for the passenger information system device 46 can be fitted to the base wall 40, but they are not illustrated in the Figures for greater clarity.

Figure 2:
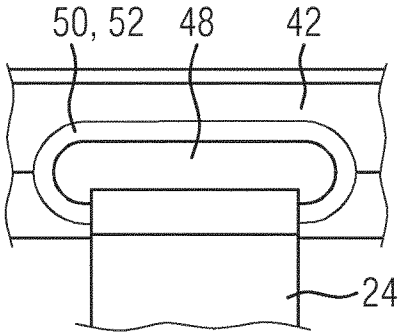
FIG. 2 is a side view of a portion of the ceiling module from FIG. 1.

In each of the two side walls 42 thereof, the carrier device 10 has a milled hinge opening 48 (cf. FIG. 2). Furthermore, the side walls 42 each have a thickened portion 50 which forms an edge 52 of the respective hinge opening 48, wherein the edge 52 of the respective hinge opening 48 at least in the lower region thereof has a rounded cross-sectional shape.

The left ceiling flap 12 in the drawing is pivotably supported on the left hinge opening 48 according to the drawing. Accordingly, the right ceiling flap 12 in the drawing is pivotably supported on the right hinge opening 48 in the drawing. Both ceiling flaps 12 are hooked with their respective hook portion 28 on the lower rim of the respective hinge opening 48.

As a result of the fact that the ceiling flaps 12 are pivotably supported on the hinge openings 48, a space-saving pivotable support of the ceiling flaps 12 is produced.

The lower rim of the respective hinge opening 48 forms for the ceiling flap 12 which is supported thereon a rotation axis about which the ceiling flap 12 can be rotated. In this instance, the rotation axes of the two ceiling flaps 12 are orientated perpendicularly to the drawing plane.

Furthermore, the carrier device 10 has a projection 54 on each of the two hinge openings 48, in particular directly above the respective hinge opening 48.

Furthermore, the ceiling module 8 has a covering unit 56 which conceals the carrier device 10. The covering unit 56 comprises an opaque covering plate 58 and two securing elements 60 which protrude from the covering plate 58 and which are constructed integrally with the covering plate 58. In the present embodiment, the covering unit 56 is produced from polycarbonate. Where applicable, the covering unit 56 may be painted.

Furthermore, the securing elements 60 each have at the end thereof remote from the covering plate 58 a portion 62 which is curved in an undulating manner. With the portions 62 thereof which are curved in an undulating manner, the covering unit 56 produces an engagement connection on the above-mentioned projections 54 of the carrier device 10.

In the closed state of the respective ceiling flap 12, the outer wall 36 thereof forms an element of the passenger space ceiling 16. In this instance, the corresponding outer wall 36 is arranged flush with the ceiling plate 58 and the remaining elements of the passenger space ceiling 16.

Other technical devices which are generally arranged in the intermediate ceiling space 20 are not illustrated in the Figures for greater clarity. These are, for example, elements of a cooling system of the rail vehicle 2 and securing elements with which portions of the passenger space ceiling 16 other than those formed by the ceiling module 8 are secured to the railcar body of the rail vehicle 2.

Any luggage stores of the rail vehicle 2 are also not illustrated in the Figures for the sake of greater clarity.

FIG. 2 is a side view of a portion of the ceiling module 8 from FIG. 1.

There is illustrated a portion of the side wall 42 of the ceiling module 8 which is arranged on the left in FIG. 1 according to the drawing. Furthermore, there is illustrated a portion of the retention element 24 which is supported on the hinge opening 48 of this side wall 42 and which as in FIG. 1 hangs in a downward direction.

Furthermore, it can be seen in FIG. 2 that the hinge opening 48 has the shape of a rounded rectangle.

The other side wall 42 of the ceiling module 8 is constructed identically to the side wall illustrated.

The description of the following embodiment is limited primarily to the differences with respect to the previous embodiment, to which reference may be made with respect to consistent features and functions. Features which are not mentioned are taken up in the following embodiment without being described again.

If the same reference numerals are used in different Figures, these refer to elements which are substantially identical or which mutually correspond. However, elements which are substantially identical or which mutually correspond may for practical reasons also be indicated with different reference numerals.

Figure 3:
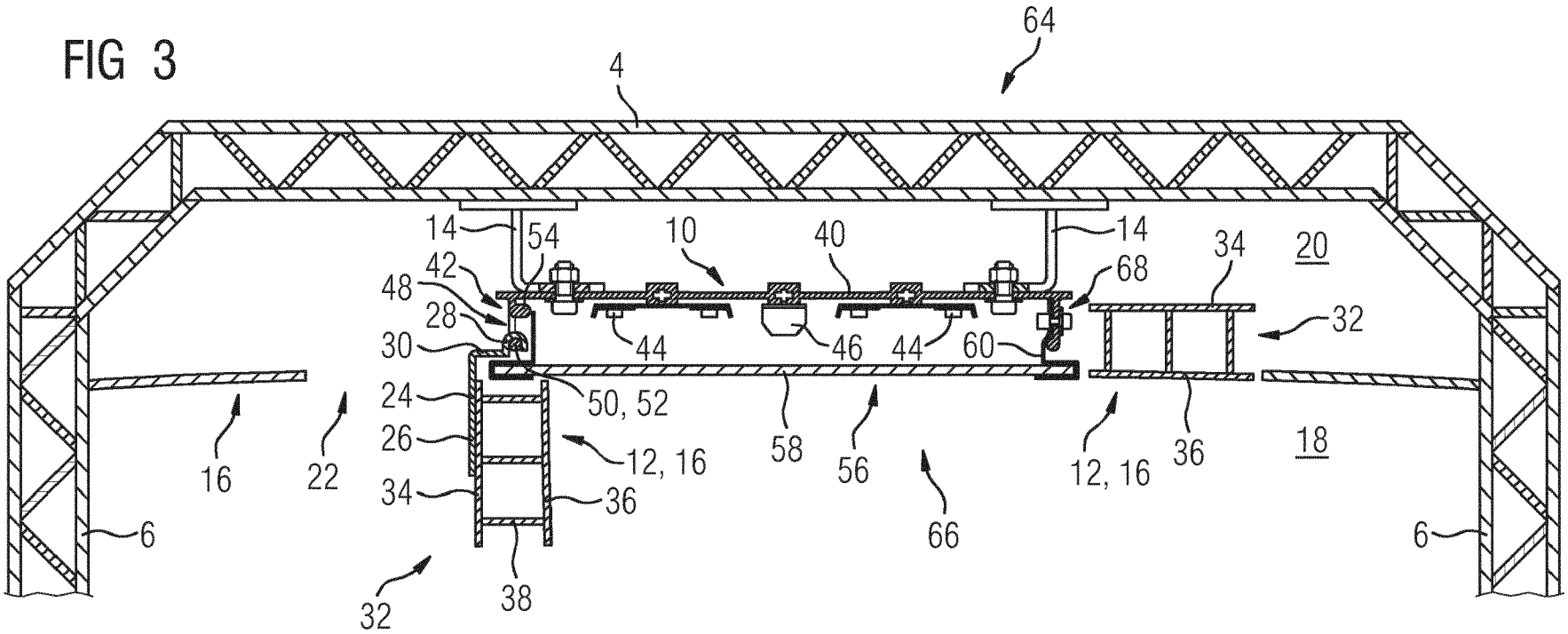
FIG. 3 is a sectioned illustration of a portion of an additional rail vehicle having another ceiling module which has a carrier device and two ceiling flaps.

FIG. 3 is a sectioned illustration of a portion of another rail vehicle 64, wherein an upper region of the rail vehicle 64 is illustrated.

This rail vehicle 64 also has a ceiling module 66. This ceiling module 66 differs from the ceiling module 8 from FIG. 1 inter alia in terms of the configuration of the covering unit 56 thereof.

In the covering unit 56 of the present embodiment, the covering plate 58 comprises opaque glass. Furthermore, the securing elements 60 of the covering unit 56 are not constructed integrally with the covering plate 58.

In the present embodiment, the securing elements 60 are shaped, painted metal sheets which are partially adhesively bonded to the covering plate 58.

Furthermore, the covering unit 56 is secured with the securing elements 60 thereof to the carrier device 10 of the ceiling module 66 not via engagement connections, but instead by means of screw connections 68, in particular by means of blind rivet nuts and screws.

For these screw connections 68, the carrier device 10 has in each of the side walls 42 thereof a slot-like securing opening 70 (cf. FIG. 4), wherein the securing openings 70 are arranged offset from each other in a direction perpendicular to the drawing plane so that, in FIG. 3, only one of the screw connections 68 can be seen.

Also in the present embodiment, each of the two side walls 42 of the carrier device 10 has a hinge opening 48, on which one of the two ceiling flaps 12 of the ceiling module 66 is pivotably supported in each case. In FIG. 3, however, only one of the hinge openings 48 can be seen since the hinge openings 48 are also arranged offset with respect to each other in a direction perpendicular to the drawing plane.

Figure 4:
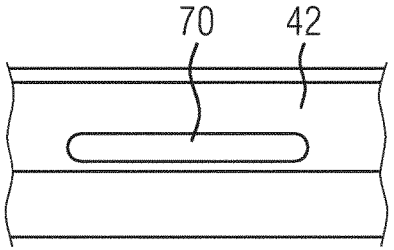
FIG. 4 is a side view of a portion of the carrier device from FIG. 3.

FIG. 4 is a side view of a portion of one of the two side walls 42 of the carrier device 10 from FIG. 3.

In FIG. 4, the previously mentioned slot-like securing opening 70 of the illustrated side wall 42 can be seen, wherein the side wall 42 is illustrated without a screw inserted into the opening 70.

Figure 5:
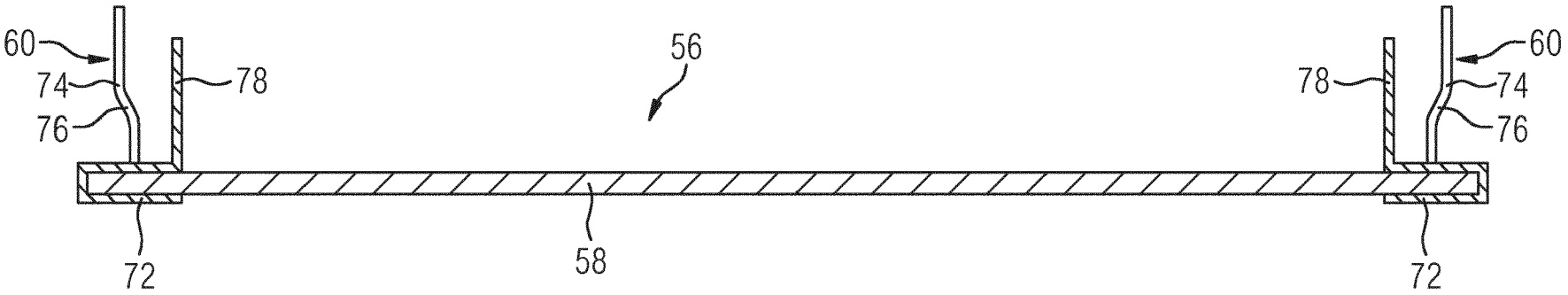
FIG. 5 is a side view of a covering unit of the ceiling module from FIG. 3.

FIG. 5 is a side view of the covering unit 56 of the ceiling module 66 from FIG. 3, wherein in addition to the covering plate 58 the securing elements 60 of the covering unit 56 can also be seen.

FIG. 5 shows that the securing elements 60 each have a U-shaped surrounding portion 72 which surrounds the covering plate 58 at the edge thereof. The securing elements 60 are adhesively bonded to the covering plate 58 at the surrounding portions 72 thereof.

Furthermore, the securing elements 60 each comprise a connection portion 74 with a curved region which has a shoulder 76. The connection portion 74 of the left securing element 60 in the drawing is arranged so as to be offset in a perpendicular direction relative to the drawing plane with respect to the connection portion 74 of the right securing element 60 in the drawing.

In the assembled state of the covering unit 56, the respective shoulder 76 rests on a thickened portion 50 of one of the two side walls 42 of the carrier device 10 (cf. FIG. 3). In addition, the securing elements 66 are screwed at the connection portions 74 thereof to the carrier device 10.

Furthermore, the securing elements 60 comprise a plurality of planar protective portions 78 which are arranged beside the respective connection portion 74. The protective portions 78 are constructed integrally with the U-shaped surrounding portion 72 and with the connection portion 74 of the respective securing element 60.

Figure 6:
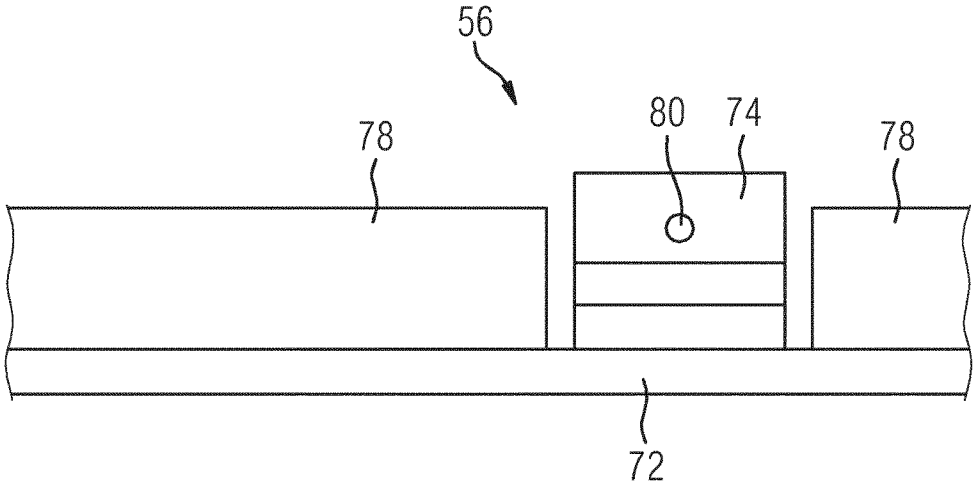
FIG. 6 is another side view of a portion of the covering unit from FIG. 5.

FIG. 6 is another side view of a portion of the covering unit 56 from FIG. 5, wherein one of the securing elements 60 of the covering unit 56 is illustrated by way of example.

In addition to the U-shaped surrounding portion 72 and the protective portions 78, in FIG. 6 the connection portion 74 of the illustrated securing element 60 can also be seen.

FIG. 6 shows that the connection portion 74 has a circular securing opening 80 through which a screw can be guided.

Although the invention has been illustrated and described more specifically in detail by the preferred embodiments, the invention is not limited by the disclosed examples and other variations can be derived from it without departing from the protective scope of the invention.

The invention claimed is:

1. A ceiling module for a vehicle, the ceiling module comprising:

a pivotally supported ceiling flap for covering a ceiling opening in a ceiling of the vehicle, said ceiling flap including a main outer wall;

a carrier device including a base wall retaining one or more electrical components, said carrier device having a side wall formed with a hinge opening, said ceiling flap being pivotally supported at said hinge opening, said ceiling flap including a retention element having a hook portion with a shape bent in a hook, and said retention element being hooked with said hook portion on an edge of said hinge opening;

said carrier device having a further side wall disposed opposite said side wall; said base wall longitudinally extending from said side wall of said carrier device to said further side wall of said carrier device;

said ceiling flap having a closed state in which all of said main outer wall of said ceiling flap extends away from said side wall in a direction and in which all of said main outer wall of said ceiling flap extends away from said further side wall in said direction.

2. The ceiling module according to claim 1, wherein said carrier device is an illumination means carrier having at least one illumination means secured thereto.

3. The ceiling module according to claim 1, wherein said hinge opening has an edge with an, at least partially, rounded cross-sectional shape, wherein a portion of said edge forms a rotation axis for a rotation of said ceiling flap.

4. The ceiling module according to claim 3, wherein said edge of said hinge opening is a thickened portion of said side wall.

5. The ceiling module according to claim 1, wherein said retention element comprises a securing portion and an intermediate portion perpendicular to said securing portion, and wherein said intermediate portion merging at one end into said securing portion and at another end into said hook portion.

6. The ceiling module according to claim 5, wherein said ceiling flap has a wall unit that is secured to said securing portion of said retention element.

7. The ceiling module according to claim 1, wherein said one or more electrical components include at least one illumination means and/or at least one passenger information system device secured to said base wall of said carrier device, and wherein said side wall formed with said hinge opening extends perpendicularly to said base wall.

8. The ceiling module according to claim 1, wherein said hinge opening has a shape of a rounded rectangle.

9. The ceiling module according to claim 1, wherein said carrier device is an extruded profile.

10. The ceiling module according to claim 1, comprising a covering unit for covering said carrier device, said covering unit including an opaque covering plate and at least one securing element, wherein said covering unit is secured to said carrier device by way of said at least one securing element.

11. A combination, comprising: a vehicle, and a ceiling module according to claim 1, wherein said ceiling module is disposed in said vehicle.

12. The combination according to claim 11, wherein said vehicle is a rail vehicle.

13. The combination according to claim 12, wherein said vehicle includes a railcar body roof, and wherein said carrier device of said ceiling module is secured to said railcar body roof.

14. The combination according to claim 11, wherein said vehicle includes a passenger space ceiling, and wherein said ceiling flap of said ceiling module forms a portion of said passenger space ceiling.

* * * * *